US007575456B2

(12) United States Patent
Cronin

(10) Patent No.: US 7,575,456 B2
(45) Date of Patent: Aug. 18, 2009

(54) RETRACTABLE UMBILICAL SYSTEM AND VEHICLE INCORPORATING SAME

(75) Inventor: James M. Cronin, Fort Worth, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 282 days.

(21) Appl. No.: 11/564,516

(22) Filed: Nov. 29, 2006

(65) Prior Publication Data

US 2008/0124961 A1 May 29, 2008

(51) Int. Cl.
*H01R 13/62* (2006.01)

(52) U.S. Cl. ..... 439/258; 89/1.811; 439/163; 439/347; 439/923

(58) Field of Classification Search ..... 439/131, 439/152, 153, 180, 258, 163, 347, 923; 89/1.811
See application file for complete search history.

(56) References Cited

U.S. PATENT DOCUMENTS 1,488,473 A * 4/1924 Brown ..... 213/1.3
2,607,863 A * 8/1952 MacFarland ..... 191/12 R
2,619,515 A * 11/1952 Doane ..... 439/274
3,038,021 A * 6/1962 Larson ..... 174/69
3,724,322 A * 4/1973 Reed ..... 89/1.811
4,508,404 A * 4/1985 Frawley ..... 439/153
5,165,670 A * 11/1992 Sawdon ..... 269/32

* cited by examiner

*Primary Examiner*—Neil Abrams
(74) *Attorney, Agent, or Firm*—Daren C. Davis; James E. Walton

(57) ABSTRACT

A retractable umbilical system includes an umbilical connector assembly, a latching connector assembly, and a retracting umbilical extending between the umbilical connector assembly and the latching connector assembly. The umbilical connector assembly is configured to bias the retracting umbilical into a retracted configuration. The latching connector assembly is configured to selectively retain the retracting umbilical in an extended configuration. The umbilical connector assembly includes a roller that is in contact with the retracting umbilical.

21 Claims, 6 Drawing Sheets

RETRACTABLE UMBILICAL SYSTEM AND VEHICLE INCORPORATING SAME

BACKGROUND

1. Field of the Invention

The present invention relates to umbilicals or umbilical cables and apparatuses incorporating such umbilicals or umbilical cables.

2. Description of Related Art

An umbilical or umbilical cable is a cable which supplies necessary requirements, such as power, signals, or the like, to a device. It is named for its similar function to an umbilical cord, such as a human umbilical cord. Generally, an umbilical includes one or more conduits adapted to conduct electrical energy, light, gases, liquids, fluids, and/or the like from one location or device to another location or device.

In some implementations, it is desirable for an umbilical to remain attached between devices. In other implementations, however, the connection between devices provided by an umbilical must be severed. One such implementation is a endoatmospheric or exoatmospheric vehicle including one or more modules that are dispensed or deployed from the vehicle. Such vehicles typically incorporate an umbilical that is physically severed by a cutter, such as a guillotine cutter, prior to deployment of the module to which the umbilical is attached. If the cutter is attached to the carrier vehicle, some portion of the umbilical extends from the module after deployment, which can present electromagnetic interferences and/or aerodynamic problems. If the cutter is attached to the module to be deployed, such electromagnetic interference and/or aerodynamic issues are addressed, but the cutter undesirably adds mass to and occupies volume in the module.

While there are many designs of umbilical systems well known in the art, considerable shortcomings remain.

SUMMARY OF THE INVENTION

There is a need for an improved umbilical system.

Therefore, it is an object of the present invention to provide an improved umbilical system.

This and other objects are achieved by providing a retractable umbilical system. The retractable umbilical system includes an umbilical connector assembly, a latching connector assembly, and a retracting umbilical extending between the umbilical connector assembly and the latching connector assembly. The umbilical connector assembly is configured to bias the retracting umbilical into a retracted configuration. The latching connector assembly is configured to selectively retain the retracting umbilical in an extended configuration.

In another aspect, the present invention provides a retractable umbilical system. The retractable umbilical system includes a retracting umbilical and an umbilical biasing assembly operably associated with the retracting umbilical to urge the retracting umbilical into a retracted configuration. The retractable umbilical system further includes a latch operable to selectively retain the retracting umbilical in communication with the latch umbilical.

In yet another aspect of the present invention, a vehicle is provided. The vehicle includes a base unit, a deployable module releasably affixed to the base unit, and an umbilical connector assembly. The vehicle further includes a latching connector assembly and a retracting umbilical extending between the umbilical connector assembly and the latching connector assembly. The umbilical connector assembly is configured to bias the retracting umbilical into a retracted configuration. The latching connector assembly is configured to selectively retain the retracting umbilical in an extended configuration.

The present invention provides significant advantages, including: (1) providing a low-mass umbilical system; (2) providing an umbilical system having a retracted umbilical after separation; and (3) providing an umbilical system that is less susceptible to aerodynamic and/or electromagnetic interference effects after separation.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
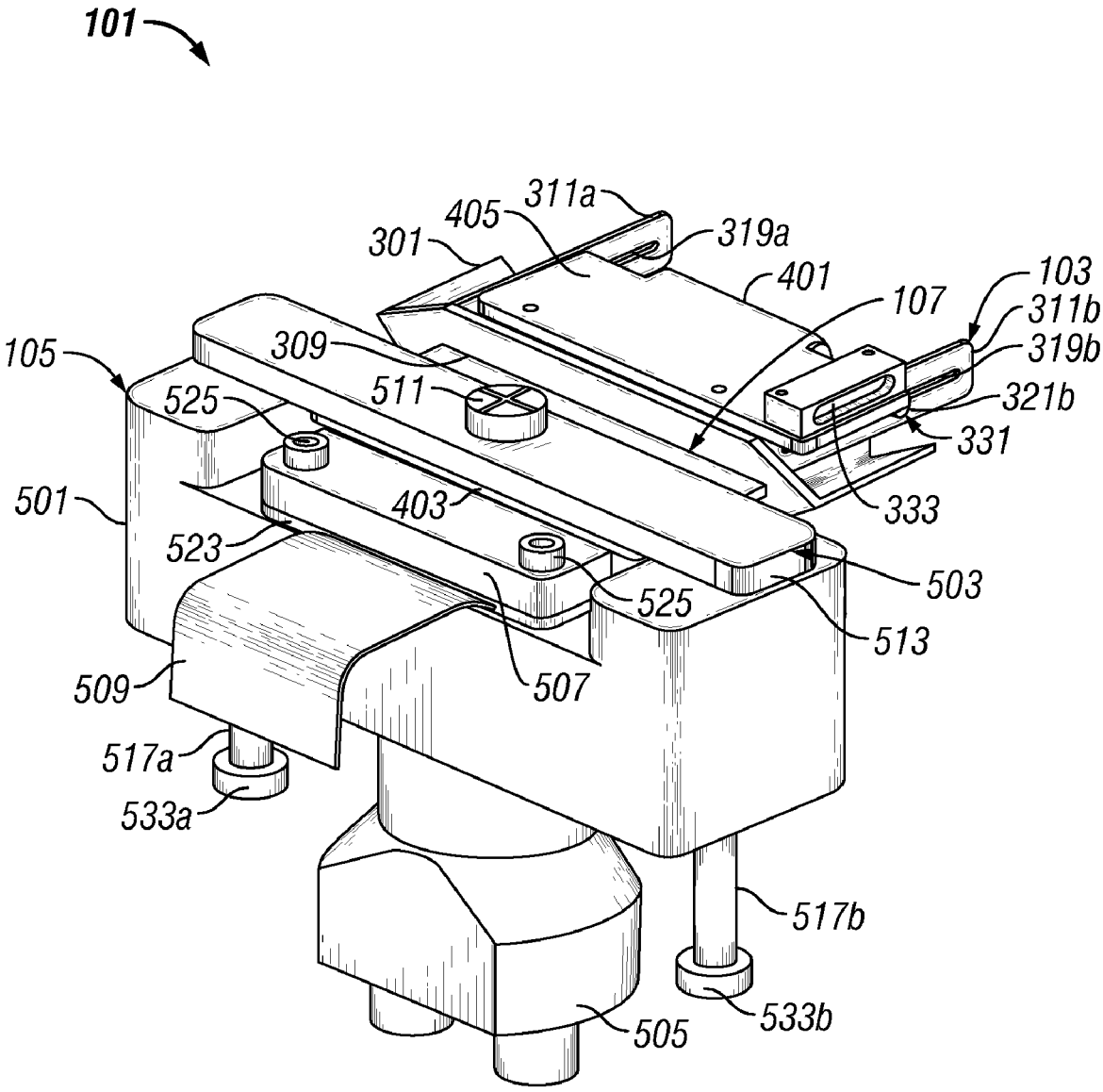
FIG. 1 is a perspective view of an illustrative embodiment of a retractable umbilical system according to the present invention, shown in a closed, latched configuration.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a retractable umbilical system and a vehicle incorporating the retractable umbilical system. The retractable umbilical system includes an umbilical connector assembly, a latching connector assembly, and an umbilical extending between the umbilical connector assembly and the latching connector assembly. A first connector of the retracting umbilical interfaces with a corresponding connector of the latching connector assembly. A second connector of the retracting umbilical is attached to the umbilical connector assembly. A latch of the latching connector assembly maintains the interface between the second connector of the retracting umbilical and the connector of the latching connector assembly. At a desired point in time, the latch of the latching connector assembly is released and the umbilical connector assembly retracts the first connector away from the latching connector assembly into the umbilical connector assembly.

In one embodiment, the retractable umbilical system is incorporated into a vehicle, such as an exoatmospheric or endoatmospheric vehicle. The umbilical connector assembly is attached to a first member of the vehicle, while the latching connector assembly is attached to a second member of the vehicle. The retracting umbilical extends between the first member and the second member. In a particular embodiment, one of the first member and the second member is deployable from the other of the first member and the second member. Preferably, the first member is a module that is deployable from the second member.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 2:
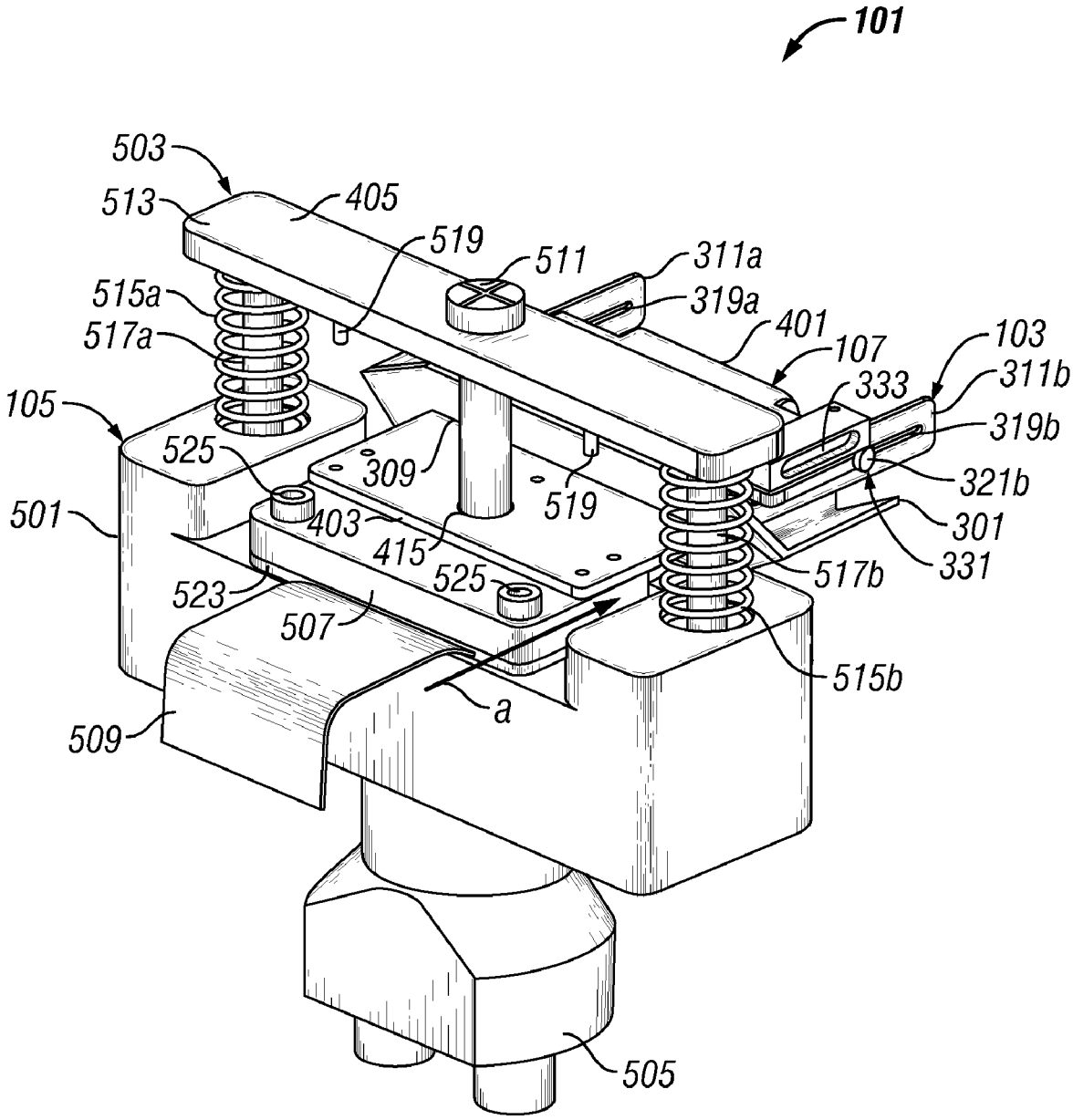
FIG. 2 is a perspective view of the retractable umbilical system of FIG. 1, shown in an open, unlatched configuration.

Referring now to FIGS. 1 and 2, an illustrative embodiment of a retractable umbilical system 101 comprising an umbilical connector assembly 103, a latching connector assembly 105, and a retracting umbilical 107 is provided. In FIG. 1, retracting umbilical 107 is held in an extended configuration by latching connector assembly 105 when in a closed, latched configuration, such that a first connector 403 (best shown in FIG. 4) of retracting umbilical 107 is mated with a connector 523 (best shown in FIG. 5) of latching connector assembly 105. Note that a second connector 405 of retracting umbilical 107 is fixedly attached to umbilical connector assembly 103. Biasing elements 515*a* and 515*b* (see FIG. 2) are preloaded in compression when latching connector assembly 105 is in the closed, latched position of FIG. 1. Moreover, biasing elements 303*a* and 303*b* (shown in FIG. 3) are preloaded in compression when retracting umbilical 107 is retained in its extended configuration of FIG. 1.

In FIG. 2, a latch 503 of latching connector assembly 105 is released to allow umbilical connector assembly 103 to retract first connector 403 of umbilical 107 from latching connector assembly 105, generally in a direction corresponding to an arrow A. Note that, as latch 503 is released, biasing elements 515*a* and 515*b* are at least partially unloaded. Moreover, biasing elements 303*a* and 303*b* (shown in FIG. 3) of umbilical connector assembly 103 are at least partially unloaded to withdraw first connector 403 from latching connector assembly 105. Operation of the illustrated embodiment of retractable umbilical system 101 is described in greater detail herein.

Figure 3:
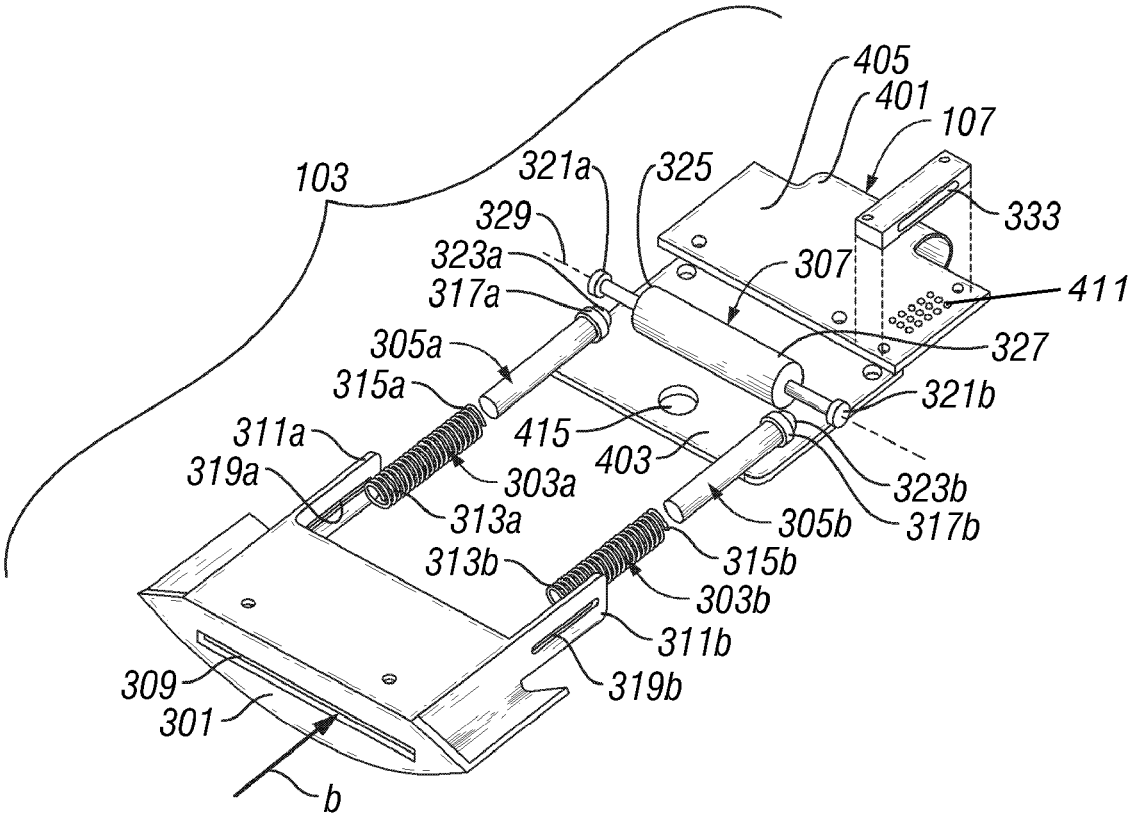
FIG. 3 is an exploded, perspective view of illustrative embodiments of an umbilical connector assembly and a retracting umbilical, both of the retractable umbilical system of FIG. 1.

Referring now to FIG. 3, an exploded, perspective view of umbilical connector assembly 103 and retracting umbilical 107 is provided. In the illustrated embodiment, umbilical connector assembly 103 comprises a bracket 301, biasing elements 303*a* and 303*b*, biasing element guides 305*a* and 305*b*, and a roller 307. Preferably, biasing elements 303*a* and 303*b* are compression springs. Bracket 301 defines a slot 309 through which retracting umbilical 107 can extend, as is discussed in greater detail herein. Biasing element guides 305*a* and 305*b* are disposed within biasing elements 303*a* and 303*b*, respectively. First ends 313*a* and 313*b* of biasing elements 303*a* and 303*b*, respectively, abut bracket 301. A second end 315*a* of biasing element 303*a* abuts a flange 317*a* of biasing element guide 305*a*. Similarly, a second end 315*b* of biasing element 303*b* abuts a flange 317*b* of biasing element guide 305*b*. Biasing element guides 305*a* and 305*b*, however, are shorter than biasing elements 303*a* and 303*b*, respectively, when biasing elements 303*a* and 303*b* are in an extended state, so that biasing element guides 305*a* and 305*b* can move with respect to bracket 301, as is discussed in greater detail herein.

Still referring to FIG. 3, bracket 301 includes prongs 311*a* and 311*b*, which define slots 319*a* and 319*b*, respectively. An axle 321*a* extends through slot 319*a*, through a fitting 323*a* of biasing element guide 305*a*, and is affixed at a first end 325 of roller 307. Similarly, an axle 321*b* extends through slot 319*b*, through a fitting 323*b* of biasing element guide 305*b*, and is affixed at a second end 327 of roller 307. Axles 321*a* and 321*b* allow roller 307 to rotate about a rotational axis 329 of roller 307. Moreover, axles 321*a* and 321*b* slide along slots 319*a* and 319*b*, respectively, so that roller 307 and biasing element guides 305*a* and 305*b* translate with respect to bracket 301. In the illustrated embodiment, biasing elements 303*a* and 303*b* are compressed and extended as biasing element guides 305*a* and 305*b*, respectively, translate with respect to bracket 301. Because roller 307 is mechanically coupled to biasing elements 303*a* and 303*b*, biasing elements 303*a* and 303*b* bias roller 307 away from slot 309 defined by bracket 301.

Figure 4:
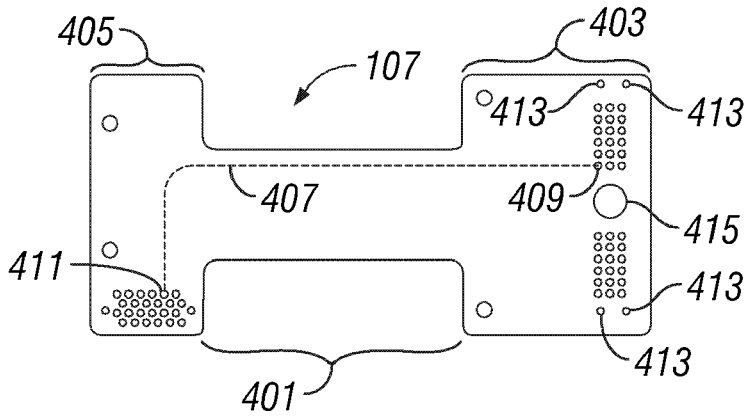
FIG. 4 is a top, plan view of the retracting umbilical of FIG. 3.

Referring now to FIG. 4, retracting umbilical 107 is shown in an unfolded configuration. In the illustrated embodiment, retracting umbilical 107 includes a flexible portion 401 disposed between first connector 403 and a second connector 405. Conduits, such as conduit 407, extend from first connector 403 to second connector 405 through flexible portion 401. Conduits, such as conduit 407, may comprise wires, metallic traces, tubes, or the like. Conduits, such as conduit 407, terminate at terminals 409 of first connector 403 and at terminals 411 of second connector 405. Terminals 411 are connected, mated, or coupled with conduits, such as wires of cable 333 (shown in FIG. 3), through which electrical energy, light, gases, liquids, fluids, and/or the like are transmitted to and/or from retracting umbilical 107. As is discussed in greater detail herein, first connector 403 extends through slot 309 of bracket 301 (shown in FIG. 3) in certain operational modes. First connector 403 defines alignment openings 413 that are configured to receive alignment pins 519 (shown in FIG. 5), as is discussed in greater detail herein. First connector 403 further defines a retention pin opening 415 configured to receive a retention pin 511 of latching connector assembly 105, as is discussed in greater detail herein.

Figure 6:
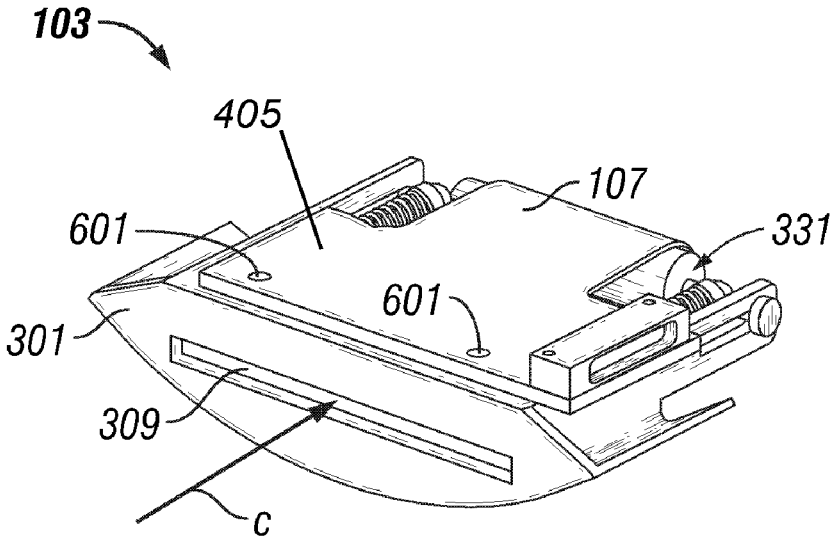
FIG. 6 is a perspective view of the umbilical connector assembly of FIG. 3 in a retracted configuration.

As best shown in FIG. 6, second connector 405 of retracting umbilical 107 is affixed to bracket 301 by fasteners 601. Thus, second connector 405 is fixedly attached to bracket 301. Returning now to FIG. 3, first connector 403 and second connector 405 are preferably rigid in nature. Flexible portion 401 of retracting umbilical 107 is disposed about roller 307, such that first connector 403 of retracting umbilical 107 is retracted into bracket 301, through slot 309, when retracting umbilical 107 is released from latching connector assembly 105 (shown in FIGS. 1 and 2) as biasing elements 303*a* and 303*b* urge roller 307 away from slot 309. An umbilical biasing assembly 331 (shown in FIGS. 1 and 2) comprises biasing elements 303*a* and 303*b*, biasing element guides 305*a* and 305*b*, axles 321*a* and 321*b*, and roller 307.

Figure 5:
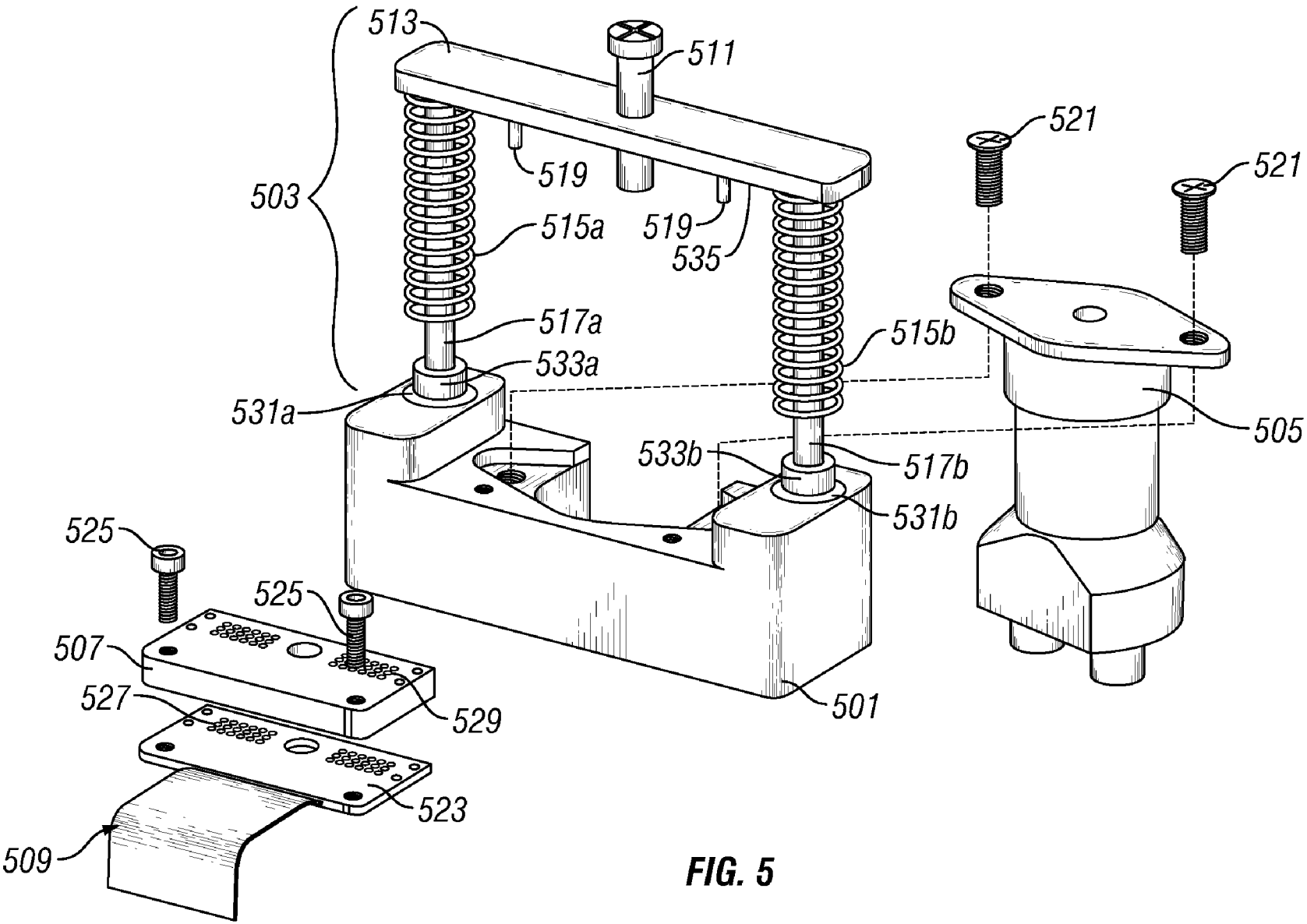
FIG. 5 is an exploded, perspective view of an illustrative embodiment of a latching connector assembly of the retractable umbilical system of FIG. 1.

FIG. 5 depicts an exploded, perspective view of latching connector assembly 105. In the illustrated embodiment, latching connector assembly 105 comprises a base 501, a latch 503, a latch release 505, a connector pad 507, and a latch umbilical 509. Latch 503 comprises retention pin 511, a cross-member 513, biasing elements 515*a* and 515*b*, biasing element guides 517*a* and 517*b*, and umbilical alignment pins 519. Latch release 505 is attached to base by fasteners 521. Connector 523 of latch umbilical 509 is attached to base 501, between base 501 and connector pad 507, by fasteners 525. Connector 523 includes terminals 527 (only one labeled for clarity) that mate, abut, or couple with terminals 529 (only one labeled for clarity) extending through connector pad 507.

Still referring to FIG. 5, base 501 defines openings 531*a* and 531*b* through which biasing element guides 517*a* and 517*b*, respectively, extend. FIG. 5 depicts biasing element guides 517*a* and 517*b* fully removed from openings 531*a* and 531*b*, respectively, to more clearly illustrate the present invention. Biasing element guides 517*a* and 517*b*, however, are retained within openings 531*a* and 531*b*, respectively, by flanges 533*a* and 533*b* of biasing element guides 517*a* and 517*b*, respectively, when latching connector assembly is in the open, unlatched configuration (as shown in FIG. 2). Biasing elements 515*a* and 515*b* are disposed about biasing element guides 517*a* and 517*b*, respectively, between base 501 and cross-member 513. Thus, biasing elements 515*a* and 515*b* bias cross-member 513 away from base 501. Retention pin 511 is attached to and extends from a lower surface 535 of cross-member 513. Umbilical alignment pins 519 extend from lower surface 535 of cross-member 513.

Referring now to FIGS. 1 and 3-5, when latching connector assembly 105 is in the latched, closed configuration, as shown in FIG. 1, retention pin 511 extends through retention pin opening 415 defined by first connector 403 of retracting umbilical 107 and into latch release 505. Also, when latching connector assembly 105 is in the latched, closed configuration, as shown in FIG. 1, umbilical alignment pins 519 extend from a lower surface 535 of cross-member 513 and into alignment openings 413 defined by first connector 403 of retracting umbilical 107. Latch release 505 retains terminals 409 of first connector 403 of retracting umbilical 107 in contact, mated, or coupled with corresponding terminals 529 of connector pad 507. As discussed herein, terminals 529 of connector pad 507 are in contact, mated, or coupled with corresponding terminals 527 of connector 523 of latch umbilical 509. Thus, retracting umbilical 107 is in communication with latch umbilical 509 via connector pad 507 when latch 503 is in the latched, closed configuration.

Referring now to FIGS. 2-5, when retracting umbilical 107 is to be retracted, latch release 505 is activated to release cross-member 513. Preferably, latch release 505 is a pyrotechnic separation device that severs retention pin 511 to release cross-member 513. In one embodiment, retention pin 511 and latch release 505 are incorporated into a single device, such as an explosive bolt from, for example, Cartridge Actuated Devices, Inc. of Fairfield, New Jersey. Upon activation of latch release 505, retention pin 511 is removed from retention pin opening 415 and umbilical alignment pins 519 are removed from alignment openings 413. Umbilical 107 is then fully released from latching connector assembly 105.

Then, as best seen in FIGS. 3 and 6, biasing elements 303*a* and 303*b* urge roller 307 away from slot 309 of bracket 301. As roller 307 moves away from slot 309, roller 307 traverses along flexible portion 401 of umbilical 107, retracting first connector 403 generally in a direction corresponding to an arrow B in FIG. 3 and an arrow C in FIG. 6, into or through slot 309.

Figure 7:
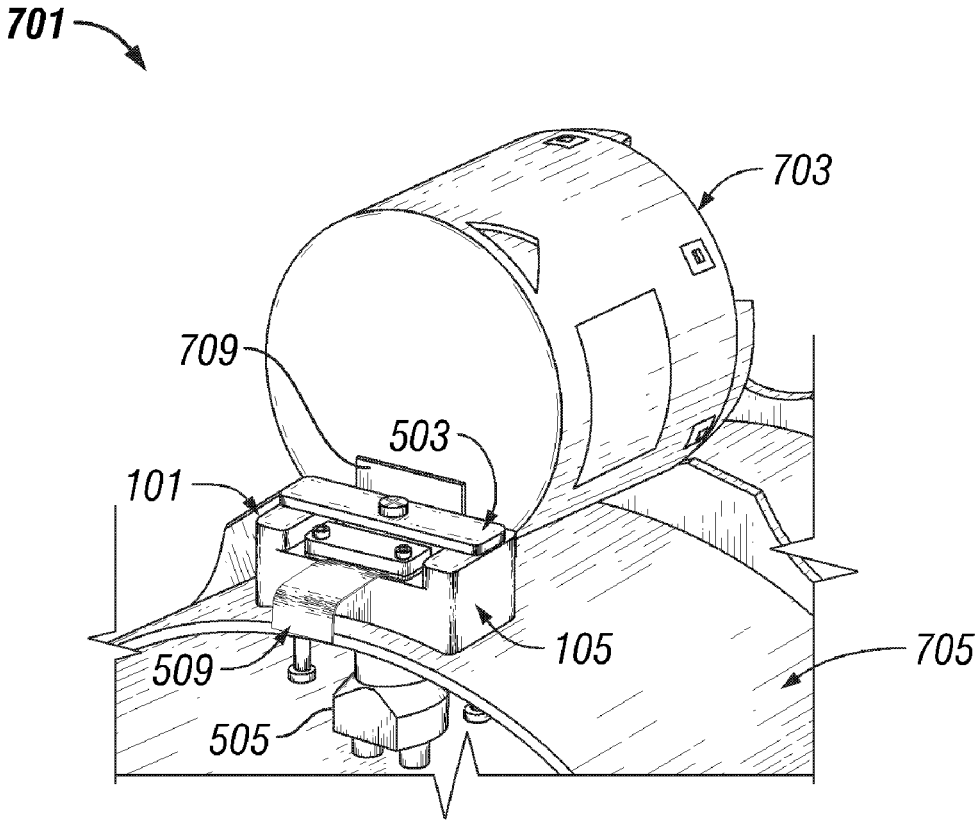
FIG. 7 is a perspective view of a portion of an illustrative embodiment of a vehicle incorporating the retractable umbilical system of FIG. 1 according to the present invention, showing the retractable umbilical system in a closed, latched configuration.
Figure 8:
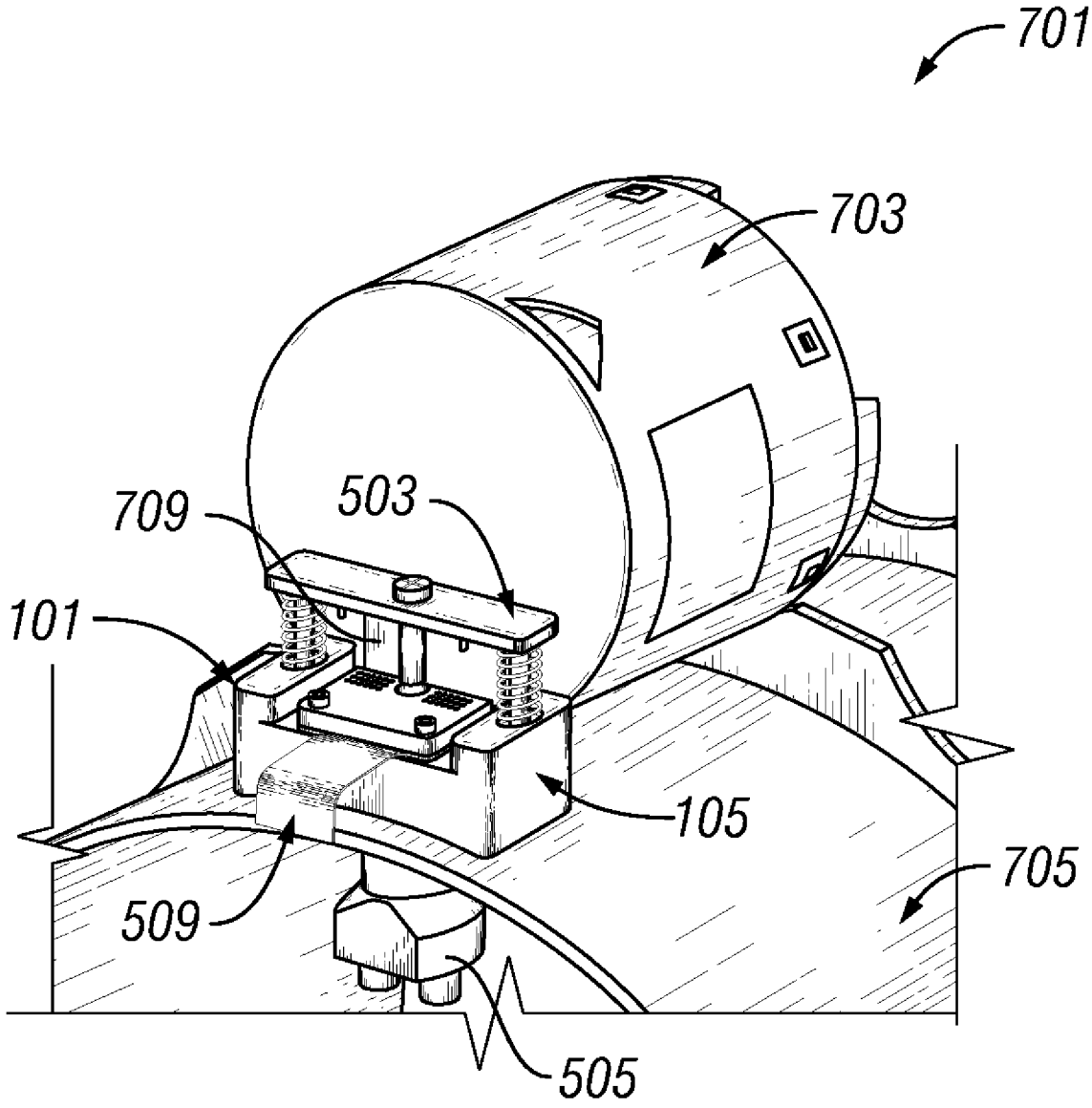
FIG. 8 is a perspective view of the portion of the vehicle of FIG. 7, showing the retractable umbilical system in an open, unlatched configuration.

FIGS. 7 and 8 depict an illustrative embodiment of a vehicle 701, such as an endoatmospheric or exoatmospheric projectile or craft, incorporating retractable umbilical system 101 of the present invention. Vehicle 701 comprises a deployable module 703 releasably attached to a base unit 705. In FIG. 7, deployable module 703 is in communication with base 705 via retractable umbilical system 101. In the illustrated embodiment, umbilical connector assembly 103 (shown in FIGS. 1-3 and 6) is disposed within deployable module 703. Latching connector assembly 105 is attached to base unit 705. In the illustrated embodiment, deployable module 703 defines an umbilical passageway through which retracting umbilical 107 extends when latching connector assembly 105 is in the locked, closed configuration to retain umbilical 107 in communication with connector pad 507, as shown in FIG. 7. The umbilical passageway is covered by an umbilical passageway door 709 when first connector 403 is retracted into deployable module 703, as is discussed below.

In FIG. 8, latch release 505 has been activated to remove retention pin 511 and umbilical alignment pins 519 from retracting umbilical 107. First connector 403 of retracting umbilical 107 is retracted into slot 309 of bracket 301, as shown in FIG. 6. Umbilical passageway door 709 covers umbilical passageway 707 to inhibit electromagnetic interference from affecting the contents of deployable module 703. Deployable module 703 can now be deployed from vehicle 701, away from base unit 705.

It should be noted that certain umbilical connector assembly embodiments contemplated by the present invention include more or less than two biasing elements, such as biasing elements 303*a* and 303*b*. For example, an umbilical connector assembly embodiment may include only one such biasing element. Moreover, it should be noted that the scope of the present invention encompasses latching connector assembly embodiments including more or less than two biasing elements, such as biasing elements 515*a* and 515*b*. For example, a latching connector assembly may include only one such biasing element. Thus, umbilical connector assembly embodiments and latching connector assembly embodiments of the present invention can comprise at least one biasing element.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated.

Although the present invention is shown in a limited number of forms, it is not limited to just these forms, but is amenable to various changes and modifications without departing from the spirit thereof.

What is claimed is:

1. A retractable umbilical system, comprising:

an umbilical connector assembly comprising a roller;

a latching connector assembly; and a retracting umbilical extending between the umbilical connector assembly and the latching connector assembly, wherein the umbilical connector assembly is configured to bias the retracting umbilical into a retracted configuration;

wherein the latching connector assembly is configured to selectively retain the retracting umbilical in an extended configuration; and wherein the roller is in contact with the retracting umbilical.

2. The retractable umbilical system, according to claim 1, wherein the latching connector assembly is configured to retain the retracting umbilical in contact with the latching connector assembly.

3. The retractable umbilical system, according to claim 1, wherein the retracting umbilical is spring-biased into the retracted configuration.

4. The retractable umbilical system, according to claim 1, wherein the umbilical connector assembly further comprises:

an umbilical biasing assembly for biasing the retracting umbilical into the retracted configuration.

5. The retractable umbilical system, according to claim 4, wherein:

the umbilical connector assembly further comprises:

a bracket having a first prong and a second prong, the first prong defining a slot and the second prong defining a slot; and the umbilical biasing assembly further comprises:

a first biasing element guide having a flange;

a second biasing element guide having a flange;

a first biasing element disposed about the first biasing element guide between the flange of the first biasing element guide and the bracket;

a second biasing element disposed about the second biasing element guide between the flange of the second biasing element guide and the bracket;

a first axle extending from a first end of the roller, through the first biasing element guide, and captured in the slot of the first prong; and a second axle extending from a second end of the roller, through the second biasing element guide, and captured in the slot of the second prong.

6. The retractable umbilical system, according to claim 4, wherein:

the umbilical comprises:

a flexible portion disposed about the roller.

7. The retractable umbilical system, according to claim 1, wherein the umbilical comprises:

a first connector a second connector configured to interface with the latching connector assembly; and a flexible portion extending between the first connector and the second connector.

8. The retractable umbilical system, according to claim 7, wherein the umbilical further comprises:

at least one conduit extending between the first connector and the second connector.

9. The retractable umbilical system, according to claim 7, wherein the second connector of the umbilical is configured to mate with a cable.

10. The retractable umbilical system, according to claim 1, wherein the latching connector assembly comprises:

a base;

a latch release; and a latch operably associated with the base and the latch release, the latch being operable to retain the umbilical in the extended configuration and being operable by the latch release to release the umbilical from the extended configuration.

11. The retractable umbilical system, according to claim 10, wherein:

the umbilical defines a retention pin opening; and the latch comprises:

a cross-member;

a retention pin extending from a lower surface of the cross-member, the latch configured to be received in the retention pin opening;

a first biasing element guide extending from the lower surface of the cross-member;

a second biasing element guide extending from the lower surface of the cross member;

a first biasing element disposed about the first biasing element between the cross-member and the base; and a second biasing element disposed about the second biasing element between the cross-member and the base.

12. The retractable umbilical system, according to claim 11, wherein:

the umbilical defines at least one alignment opening; and the latch further comprises:

at least one umbilical alignment pin corresponding to the at least one alignment opening defined by the umbilical.

13. The retractable umbilical system, according to claim 10, wherein the latch release comprises:

a pyrotechnic separation device operable to sever the retention pin.

14. The retractable umbilical system, according to claim 10, wherein the retention pin and the pyrotechnic separation device form an explosive bolt.

15. The retractable umbilical system, according to claim 1, wherein the latching connector assembly further comprises:

an umbilical; and a connector pad configured to mate with the retracting umbilical and the umbilical of the latching connector assembly.

16. A retractable umbilical system, comprising:

a retracting umbilical;

an umbilical biasing assembly operably associated with the retracting umbilical to urge the retracting umbilical into a retracted configuration, the umbilical biasing assembly comprising a roller in contact with the retracting umbilical; and a latch operable to selectively retain the retracting umbilical in communication with the latch umbilical.

17. The retractable umbilical system, according to claim 16, further comprising:

a connector pad;

wherein the latch is configured to retain the retracting umbilical in contact with the connector pad.

18. The retractable umbilical system, according to claim 16, wherein the retracting umbilical is spring-biased into the retracted configuration.

19. A vehicle, comprising:

a base unit;

a deployable module releasably affixed to the base unit;

an umbilical connector assembly comprising a roller;

a latching connector assembly; and a retracting umbilical extending between the umbilical connector assembly and the latching connector assembly;

wherein the umbilical connector assembly is configured to bias the retracting umbilical into a retracted configuration;

wherein the latching connector assembly is configured to selectively retain the retracting umbilical in an extended configuration; and wherein the roller is in contact with the retracting umbilical.

20. The vehicle, according to claim 19, wherein the latching connector assembly is configured to retain the retracting umbilical in contact with the latching connector assembly.

21. The vehicle, according to claim 19, wherein the retracting umbilical is spring-biased into the retracted configuration.

* * * * *